US005563562A

United States Patent [19]

Szwec

[11] Patent Number: 5,563,562

[45] Date of Patent: Oct. 8, 1996

[54] RF FEED-THROUGH CONNECTOR

[75] Inventor: Richard J. Szwec, Roanoke, Va.

[73] Assignee: ITT Industries, Inc., New York, N.Y.

[21] Appl. No.: 410,356

[22] Filed: Mar. 24, 1995

[51] Int. Cl.[6] ..... H01P 1/04

[52] U.S. Cl. ..... 333/260; 174/152 GM; 439/581

[58] Field of Search ..... 333/260; 439/63, 439/581, 675, 935; 174/88 C, 152 GM

[56] References Cited

U.S. PATENT DOCUMENTS

| | | | |
|---|---|---|---|
| 3,119,052 | 1/1964 | Tsuji . | |
| 3,223,959 | 12/1965 | Abbott . | |
| 3,371,413 | 3/1968 | Rundle . | |
| 3,439,294 | 4/1969 | Flanagan et al. | 333/260 X |
| 3,685,005 | 8/1972 | D'Alessandro . | |
| 3,705,379 | 12/1972 | Bogar | 333/260 X |
| 3,725,829 | 4/1973 | Brown | 333/260 X |
| 3,936,125 | 2/1976 | Hutter | 333/260 X |
| 4,174,145 | 11/1979 | Oeschger | 174/152 GM |
| 4,352,951 | 10/1982 | Kyle | 174/152 GM |
| 4,421,947 | 12/1983 | Kyle | 174/152 GM |
| 4,647,122 | 3/1987 | Kelly | 29/845 X |
| 4,669,805 | 6/1987 | Kosugi et al. | 333/260 X |
| 4,716,082 | 12/1987 | Ahearn . | |
| 4,824,399 | 4/1989 | Bogar et al. | 333/260 X |
| 4,841,101 | 6/1989 | Pollock | 174/152 GM |
| 4,915,719 | 4/1990 | Saffari | 174/50.63 X |
| 4,935,583 | 6/1990 | Kyle | 174/152 GM |
| 4,940,858 | 7/1990 | Taylor | 174/152 GM |
| 4,984,973 | 1/1991 | Itameri-Kinter | 174/152 GM X |
| 5,223,672 | 6/1993 | Pinneo | 174/52.4 |
| 5,298,683 | 3/1994 | Taylor | 174/152 GM |

FOREIGN PATENT DOCUMENTS

| | | | |
|---|---|---|---|
| 46487 | 4/1977 | Japan | 174/152 GM |

*Primary Examiner*—Benny Lee
*Attorney, Agent, or Firm*—Thomas L. Peterson

[57] ABSTRACT

A miniature coaxial connector with a mating end for mating to another connector and a termination end for direct connection to a circuit, provides a closely controlled impedance along its entire length. The connector comprises a coax assembly (14, FIG. 2) having a glass bead (120), a conductive pin (28) projecting through the bead, and a conductive impedance member (40) surrounding the bead. The coax assembly is installed in a connector body (12) having a hollow front mating end portion (50) and a rear end portion (52). The impedance member of the coax assembly has a flange (46) lying on the front face (34) of the bead, and the rear of the body includes a precision passage (60) with the pin projecting completely through the passage and with only air between the pin and passage walls. This arrangement provides precision alignment of the pin with grounded conductive surfaces surrounding it. The flange provides a precision transformer at the front of the pin where it will engage a socket of a mating connector.

4 Claims, 2 Drawing Sheets

RF FEED-THROUGH CONNECTOR

BACKGROUND OF THE INVENTION

There are applications that require subminiature coaxial connectors in which the center conductor, or pin, has an outside diameter of no more than about 0.5 mm (0.02 inch), and where the connector must have a precisely controlled impedance (usually 50 ohms) for minimal loss. One prior art approach is to inject a flowable dielectric of large dielectric constant such as glass, into a body and around a pin contact, with the glass bonding to both of them. The resulting glass bead may have a decidedly curved front face, and some glass can leak beyond portions of the pin which are intended to be surrounded only by air, thereby significantly affecting the impedance at that portion of the connector. In some installations, the rear of the connector projects into a hole of a grounded metal panel, and the pin contact is connected to a circuit such as one on a circuit board lying behind the panel. If a portion of the panel hole is to form part of the outer coaxial conductor through which the pin projects, then losses are likely there because of imprecision in manufacture and installation. If a socket is to be projected around the rear end of the pin, then this also can lead to impedance changes and consequent losses. A miniature radio frequency (usually at least 100 MHz) coaxial connector whose inner and outer contacts were precisely positioned along their lengths, and especially along the rear of the inner or pin contact up to where it engaged a circuit, would be of value.

SUMMARY OF THE INVENTION

In accordance with one embodiment of the present invention, a miniature coaxial connector is provided which maintains its inner and outer contacts precisely concentric, and which otherwise minimizes losses. The connector includes a coax assembly that is separately manufactured and that can be tested prior to insertion into an electrically conductive connector body. The coax assembly includes a glass-like bead, a pin contact or pin projecting through a hole at the axis of the bead, and a conductive impedance member having a cylindrical portion surrounding the bead and having a flange lying on a front face of the bead. The connector body has a hollow front mating end and a hollow rear termination end with a passage, and also has a middle. The coax assembly lies in the hollow middle, with the pin having a front pin portion projecting into the hollow front end and having a rear pin portion projecting into the rearwardly extending passage. The coax assembly is separately and precisely made by melting a glass preform to form the bead, and is separately tested. After installation the flange lies at the front of the bead to act as a transformer near a mating contact, while the rear pin end projects through the precisely concentric passage wall with the pin extreme rear end projecting rearwardly out the passage.

An installation that uses the connector, includes a metal panel with a hole through which the rear of the connector body projects, with a circuit board lying at the rear of the hole and with a trace on the circuit board face lying in line with the passage. The rear end of the pin is directly attached to the trace as by soldering.

The novel features of the invention are set forth with particularity in the appended claims. The invention will be best understood from the following description when read in conjunction with the accompanying drawings.

DESCRIPTION OF THE PREFERRED EMBODIMENT

Figure 1:
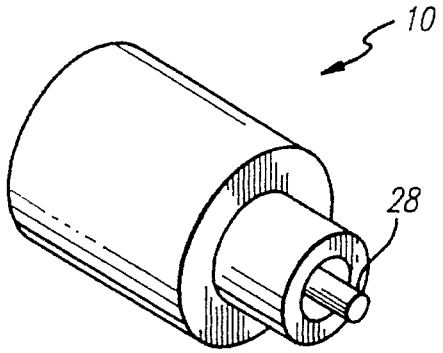
FIG. 1 is a rear isometric view of the connector of the present invention.
Figure 2:
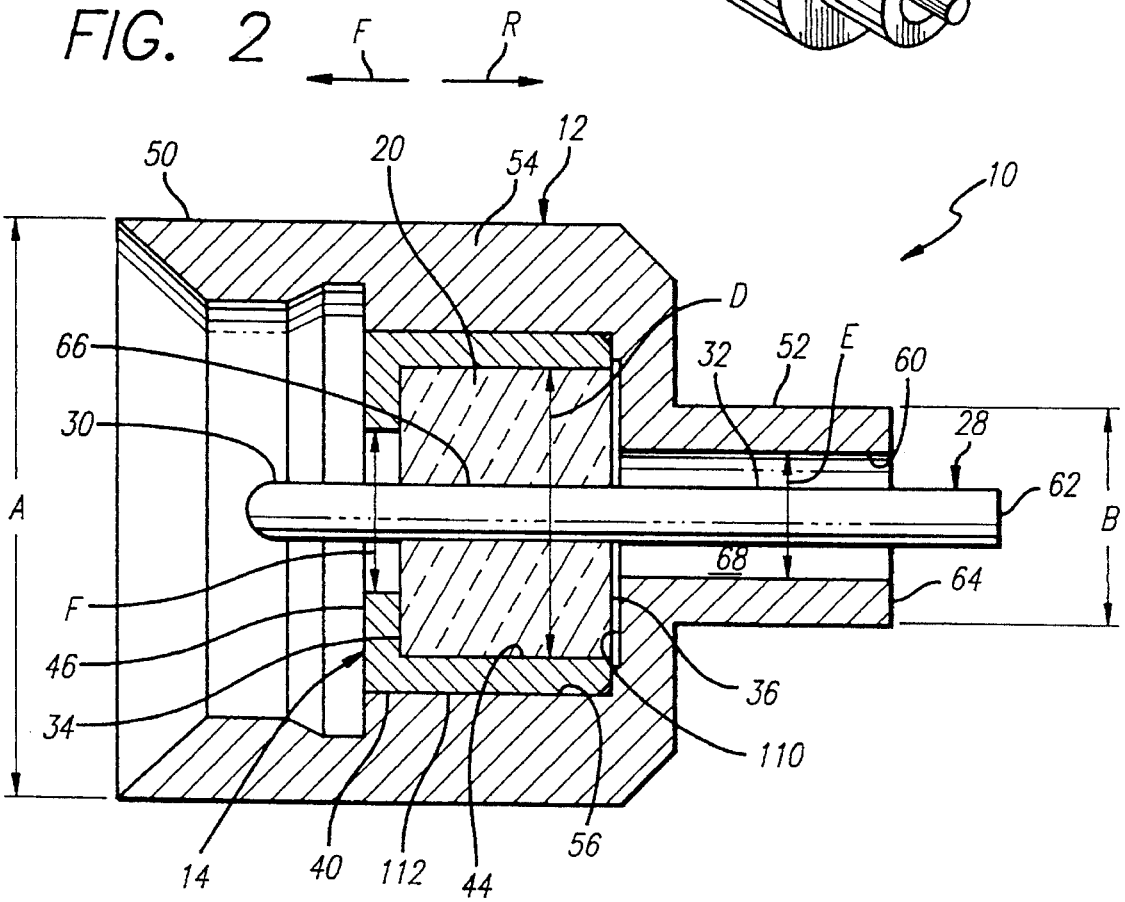
FIG. 2 is a sectional view of the connector of FIG. 1.

FIG. 2 illustrates a radio frequency coaxial connector 10 of the present invention, which includes an electrically conductive body, 12 and a coax assembly 14 mounted in the body. The connector can be considered to be miniature because the particular outside diameter A is only 0.16 inch (4 millimeters) in diameter. It has a rear portion of a diameter B of 0.06 inch (1.53 mm) which enables it to be installed in a small hole in a metal panel. Forward and rearward directions are indicated by arrows F, R.

Figure 3:
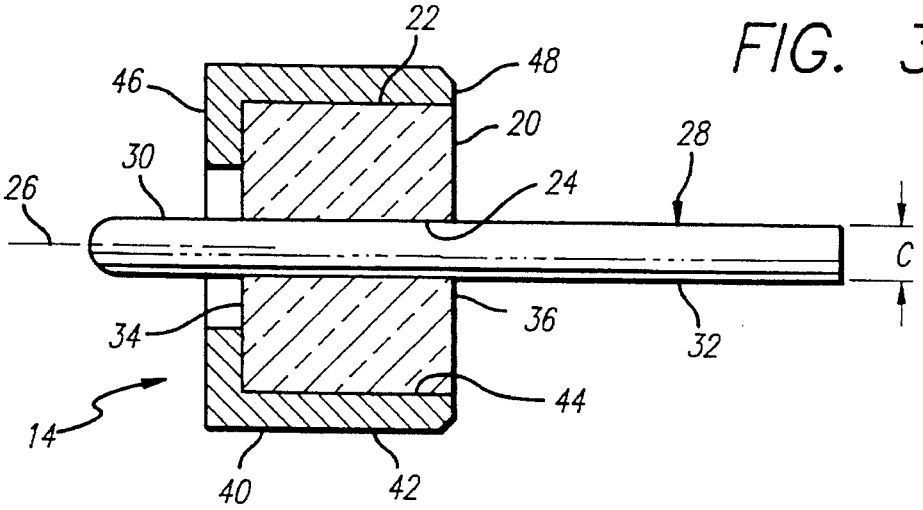
FIG. 3 is a sectional view of only the coax assembly of the connector of FIG. 2.

As shown in FIG. 3, the coax assembly 14 includes a bead 20 that is preferably of glass (although other materials of high dielectric constant such as quartz or a ceramic could be used) which has a cylindrical periphery 22 and a hole 24 extending along its axis 26. An inner coaxial contact 28 may be referred to as a pin because of its very small diameter C of 0.015 inch (0.4 mm). The pin extends through the hole in the bead, with front and rear pin portions 30, 32 projecting forwardly and rearwardly of the front and rear faces 34, 36, respectively, of the bead. An electrically conductive impedance member 40 includes a portion 42 that is cylindrical in that it has a cylindrical inner surface 44 that surrounds the periphery 22 of the bead. The impedance member also has a radially inwardly-extending flange 46 that lies on the front face 34 of the bead. The impedance member has an extreme rear end 48 that lies flush with the bead rear face 36. The bead is bonded to the pin 28 and to the impedance member 40.

The coax assembly 14 is manufactured and can be tested as a separate unit. Thereafter, it is installed in the body 12 and fixed in place as by brazing. Returning to FIG. 2, the body has a hollow front mating end portion 50, a hollow rear termination portion 52, and a hollow middle 54, with all body portions being integral. The coax assembly 14 lies in a cavity 56 in the hollow middle of the body. The pin front portion 30 projects into the hollow front end while the pin rear portion 32 projects through a passage 60 formed at the hollow rear termination portion 52 of the body. The passage 60 has cylindrical walls which are precisely concentric with the straight cylindrical pin 28. It can be seen that the pin portion 32 that lies within the body rear end has a continuous, or uninterrupted, cylindrical outer pin surface. The pin has an extreme rear end 62 that projects rearwardly beyond the rear end 64 of the rear termination portion 52. The inside diameter D of the dielectric-filled space surrounding the middle portion 66 of the pin depends upon the dielectric constant of the glass bead, which is about 4. The inside diameter E of the axially-elongated dielectric space 68 that is occupied by air, is about one-half the diameter D because the square root of the dielectric constant of air (which is 1)

is about one-half of the square root of the dielectric constant of the glass bead. The inside diameter F of the air-filled space between the flange 46 and pin is about one-third larger than the diameter E, as it extends along a short axial length and serves as a transformer.

Figure 4:
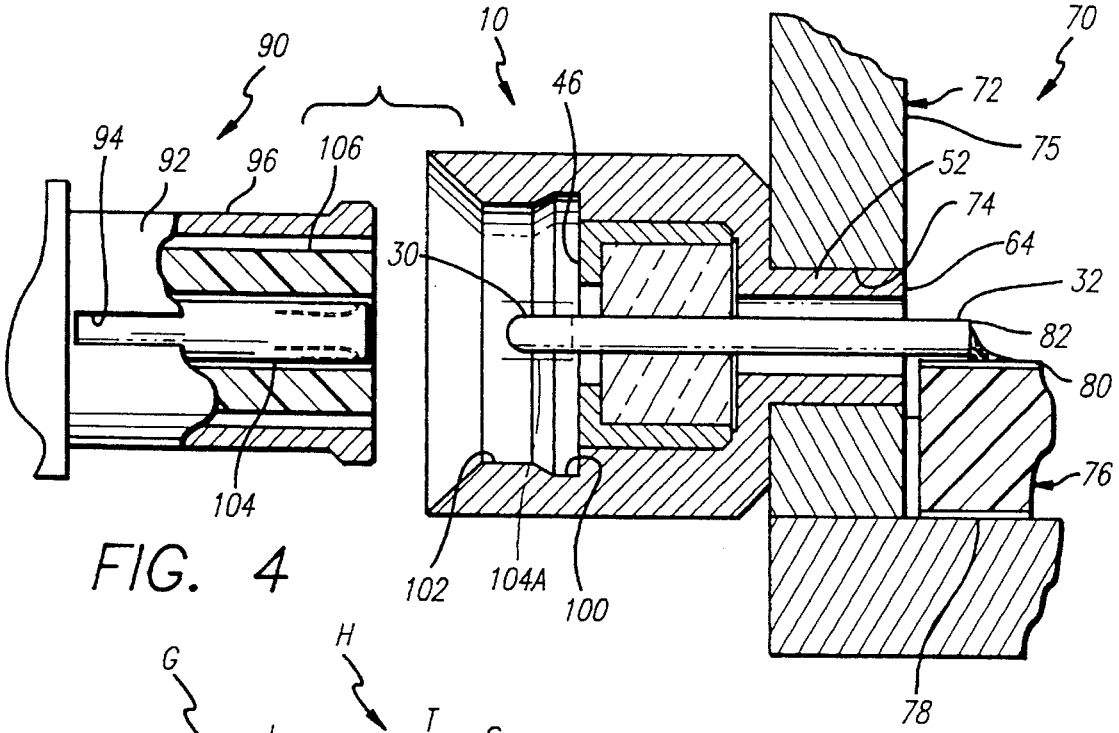
FIG. 4 is an exploded view of the connector of FIG. 2 and of a portion of a mating connector, and also showing the connector of FIG. 2 mounted on an installation.

FIG. 4 shows the connector 10 mounted at an installation 70 that includes a metal panel 72 with a hole 74, with the termination portion 52 of the connector extending through the hole 74 and held in place as by brazing to the panel. The rear end 64 of the rear termination portion should lie flush or, as shown in FIG. 4, only very slightly forward of the panel rear face 75, but may extend rearward of the panel rear face. The installation also includes a circuit board 76 having a ground plane 78 on its lower face and having circuitry including a signal-carrying trace 80 on its upper face. The rear pin portion 32 has a rear end 82 that is connected to the trace 80 as by solder. A mating second connector 90 has an electrically conductive body 92 with slots 94 that form tines 96 which press against the inside surface 100 of the first connector, and which latch against a latch 102 therein. A variety of connector mating configurations are available. The second connector has a shrouded socket contact 104 that mates with the pin front portion 30, and has a TEFLON insulator 106 lying around the socket contact. When the connectors are mated, the socket contact lies at the position 104 A. The flange 46 serves as a transformer that maintains a close to desired impedance in the region between the front end of the bead 20 and the socket contact.

Figure 5:
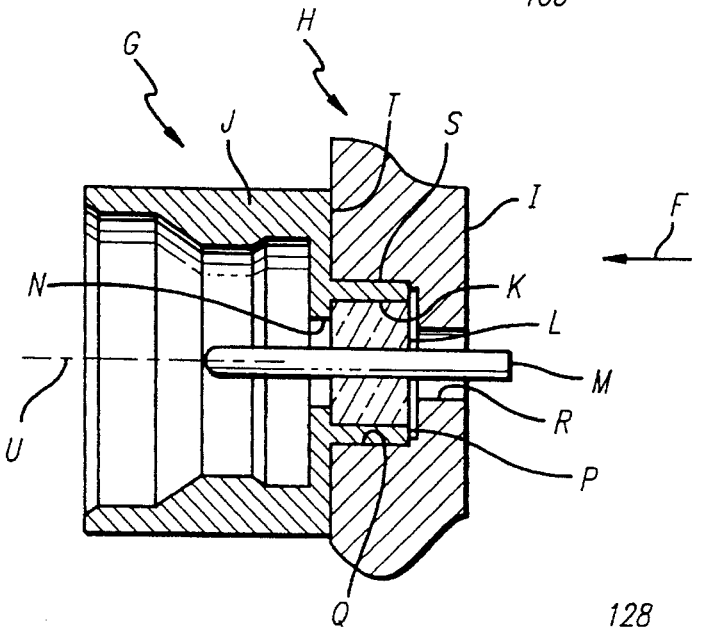
FIG. 5 PRIOR ART
FIG. 5 is a sectional view a prior art connector.

FIG. 5 shows one prior art connector G and an installation H wherein the connector is mounted on a panel I. The connector includes a body J that has a rear portion with a cylindrical inner surface K that surrounds a glass bead L through which a pin M extends. A radially-inwardly extending flange N lies against the front of the glass bead.

The central contact M can be inserted through the glass bead L and the glass bead moved forwardly in the direction F into place in the connector, or molten glass can be injected into the indicated space. The rear end P of the body lies flush with the rear face of the glass bead. The panel I is drilled with a countersunk hole having a large diameter part Q and having a small diameter part R. The small diameter part R has a diameter about half that of the inside diameter K to account for the differences in dielectric constant of the glass and air, to maintain a largely constant characteristic impedance. The body is brazed at locations S, T to the panel I.

A disadvantage of the prior art shown in FIG. 5, is that the walls of the hole R may not lie precisely concentric with the outside surface of the cylindrical pin M. The distance by which the axis U of the pin is off center from the center of the hole part R is a major factor in determining losses. Since the diameter of the surface R is only about sixty thousandths inch (1.5 mm), it is very difficult to assure precise concentricity since the surfaces at S and T are brazed. There is an accumulation of tolerances in the manufacture and installation of the pin M in the body, in the machining of the body outside surface S, in the boring of the hole parts Q, R, and especially in the mounting of the body rear end pin in the panel hole due to the need for clearance. It is difficult to manufacture each part to a tolerance of less than about 0.001 inch. Where the connector is of moderate size, as where the inside diameter E (FIG. 2) of the air-filled pin-receiving passage is one-eighth inch or larger, the accumulation of perhaps a dozen tolerance of one thousandth inch each, results in moderately accurate mounting. However, for a subminiature connector where the diameter E is only 0.06 inch, such a large number of accumulated tolerances can result in a large deviation of concentricity between the pin and the elongated air-filled passage through which it extends. A subminiature coaxial connector may be defined as one where the minimum diameter C of the central conductor is no more than about twenty thousandths inch.

The prior art connector of FIG. 5 compares with applicant's connector shown in FIG. 2, where the concentricity is controlled by the machining the body surfaces 60, 56 at the same time in an integral piece of metal. Also, applicant uses a precision factory fit of the outside of the impedance member 40 with the walls of the cavity 56. Furthermore, applicant's connector can be tested for losses prior to installing it.

The coax assembly 14 is constructed by first casting glass in a mold to form a bead 20 with a hole 24, with such bead being referred to as a glass preform. The preform is constructed so its faces are largely flat, which can be accomplished by careful molding of the faces. The pin 28 and impedance member 40 are both machined parts, which are formed of a material having about the same low thermal coefficient of expansion as glass, with KOVAR (of iron, nickel, and cobalt) commonly used. The surfaces of the pin and impedance member are oxidized so they will readily bond to the glass. The pin is projected through the hole 24 in the preform while the preform is inserted into the impedance member, and the glass preform is heated just enough to allow the glass to bond to the oxide coatings of the pin and impedance member. Such heating results in predictable deformation of the glass preform, so its front and rear faces have predictable shapes (slightly concave), which allows a design that avoids losses. After cooling, the exposed metal surfaces of the coax assembly 14 are deoxidized and plated with an oxidation-resisting metal material. Preliminary tests can be made to assure that there will be low losses. The coax assembly is inserted into the machined body 12, until the rear face 36 of the glass bead lies facewise close to a rearwardly-facing wall 110 (see FIG. 2) of the body. The impedance member 40 is then brazed in place at 112 (see FIG. 2) to the body. The long length of the rear termination portion 52 allows a greater surface for brazing, which increases strength and hermeticity. Further performance tests then can be conducted.

Applicant has built and tested subminiature connectors of the dimensions described above, and installed them in the above installation, and found the connectors to provide unusually low losses for connectors of this size.

Figure 6:
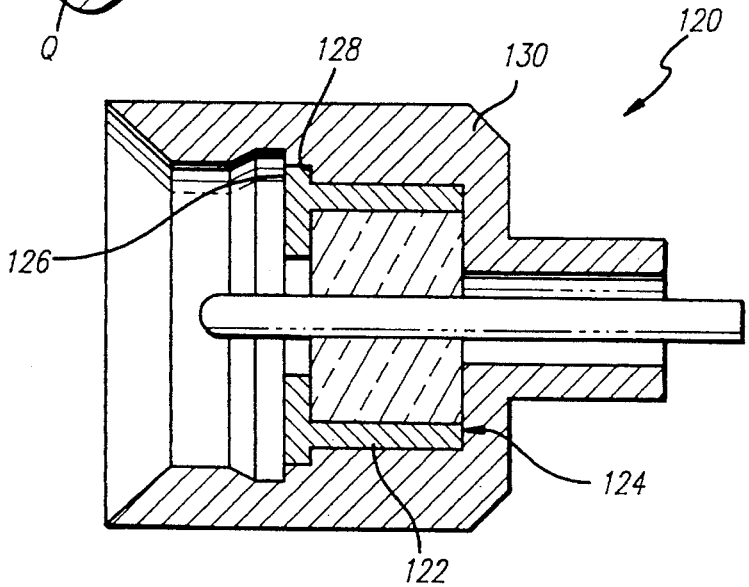
FIG. 6 is a sectional view of connector of another embodiment of the invention.

FIG. 6 shows a connector 120 that is similar to the connector of FIG. 2, except that the impedance member 122 of the coax assembly 124 includes a ledge 126 that lies against a forwardly-facing surface 128 of the body 130. The advantage of this arrangement, is that the ledge 126 provides an additional region for brazing to the body to assure secure attachment of the subminiature coax assembly to the body.

Thus, the invention provides a subminiature coaxial connector which assures high precision, especially concentricity, of the inner conductor or pin with the outer conductor, to achieve low losses. The connector includes a separately constructed coax assembly with a cup-shaped impedance member having a cylindrical inner surface surrounding a glass bead and having a flange lying against the front face of the bead, with a pin projecting through the bead. The coax assembly lies in a conductive body having an elongated narrow passage at its rear end, with the rear portion of the pin projecting through the narrow passage and slightly beyond it. When installed in a metal panel, the metal panel is drilled with a simple hole into which the rear portion of the connector body fits. Any slight nonconcentricity of the pin with the walls of the panel does not matter, since all of the rear portion of the pin that is surrounded by metal, is surrounded by the walls of the passage in the connector body.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A miniature RF coaxial connector for use at frequencies on the order of magnitude of at least 100 kHz, which has a mating end for connection to a mating connector and a termination end for termination to a circuit comprising:

a coax assembly that includes a glass-like dielectric bead having an axis extending therethrough, said dielectric bead having front and rear faces and having a periphery extending between said faces, a conductive pin projecting through said bead along said axis and fixed to said bead, and a conductive impedance member having a cylindrical portion surrounding said bead periphery and fixed thereto, said impedence member further having a radially inwardly-extending flange lying on said bead front face;

an electrically conductive connector body having a hollow front mating end portion, a hollow rear termination end portion, and a hollow middle, with said front end portion, said rear end portion and said middle being integral, said coax assembly including said impedance member lying in said hollow middle, and said pin having front and rear end portions projecting respectively into said body front end portion and said body rear end portion;

said bead periphery having a diameter, said body rear end portion having a precision cylindrical inner surface defining a passage of smaller diameter than the periphery of said bead, and said pin rear end portion projecting through said passage;

said impedance member having a first inside diameter, said body rear end portion inner surface having a second diameter which is about half said first inside diameter, and with substantially only air lying between said body rear end portion inner surface and said pin, and with the portion of said pin that lies within said body rear end portion inner surface having an uninterrupted cylindrical outer pin surface.

2. A subminiature RF coaxial connector for use at frequencies on the order of magnitude of at least 100 kHz, which has a mating end for connection to a mating connector and a termination end for termination to a circuit comprising:

a coax assembly that includes a glass-like dielectric bead having an axis extending therethrough, said dielectric bead having a periphery and front and rear faces, a conductive pin projecting through said bead along said axis and fixed to said bead, and a conductive impedance member having a cylindrical portion surrounding said bead periphery and fixed thereto, said impedance member further having a radially inwardly-extending flange lying on said bead front face;

said pin having an outside diameter that is no more than about 0.5 mm, and being comprised of solid metal;

an electrically conductive connector body having a hollow front mating end portion, a hollow rear termination end portion, and a hollow middle, with said front end portion, said rear end portion and said middle being integral, said coax assembly lying in said hollow middle and with said pin having front and rear end portions projecting respectively into said body front end portion and said body rear end portion;

said bead periphery having a diameter, said body rear end portion having a precision cylindrical inner surface forming a passage which has a passage diameter that is of smaller diameter than said bead perimeter diameter, said pin rear end portion projecting through said passage, and substantially only air lies directly between said body rear end portion and said pin.

3. An installation that includes an electrically conductive grounded panel that has front and rear faces and a through panel hole, and a circuit board having a conductive trace, said circuit board mounted with respect to said panel so said conductive trace lies substantially in line with said panel hole and beyond said panel rear face, including a coax assembly that includes a glass-like dielectric bead having an axis extending therethrough, said dielectric having a periphery and front and rear faces, a conductive pin projecting through said bead along said axis and fixed to said bead, and a conductive impedance member having a portion with cylindrical inner and outer surfaces and surrounding said bead periphery and fixed thereto, said impedence member further having a radially inwardly-extending flange lying on said bead front face and bonded to said bead;

an electrically conductive connector body having a hollow front mating end portion, a hollow rear end portion, and a hollow middle, with said front end portion, said rear end portion and said middle being integral, said coax assembly lying in said hollow middle with said pin having front and rear end portions projecting respectively into said body front end portion and said body rear end portion;

said body rear end portion having a precision cylindrical inner surface forming a passage of smaller diameter than the periphery of said bead, and said pin rear end portion projects through said passage;

said body rear end portion lies in said panel and projects substantially completely through said hole in said panel, and said pin rear end projects rearward of said body rear end portion and is connected to said conductive trace on said circuit board.

4. The installation described in claim 3 wherein:

said body rear end portion has a rear end (64) that lies substantially flush with said panel rear face (75).

* * * * *